US007562471B2

(12) United States Patent
Minami

(10) Patent No.: US 7,562,471 B2
(45) Date of Patent: Jul. 21, 2009

(54) ARTICLE OF FOOTWEAR WITH GRIPPING SYSTEM

(75) Inventor: Tetsuya T. Minami, Portland, OR (US)

(73) Assignee: Nike, Inc., Beaverton, OR (US)

( * ) Notice: Subject to any disclaimer, the term of this patent is extended or adjusted under 35 U.S.C. 154(b) by 90 days.

(21) Appl. No.: 11/566,631

(22) Filed: Dec. 4, 2006

(65) Prior Publication Data

US 2008/0127524 A1 Jun. 5, 2008

(51) Int. Cl.
*A43B 5/02* (2006.01)

(52) U.S. Cl. ..... 36/133; 36/128

(58) Field of Classification Search ..... 36/133, 36/128, 45

See application file for complete search history.

(56) References Cited

U.S. PATENT DOCUMENTS

| | | | | |
|---|---|---|---|---|
| 660,284 | A | | 10/1900 | Webber |
| 1,542,848 | A | | 6/1925 | Barnes |
| 1,617,430 | A | * | 2/1927 | Wolfelt ..... 36/45 |
| 1,677,370 | A | | 7/1928 | Roewade |
| 2,088,851 | A | | 8/1937 | Gantenbein |
| 2,241,653 | A | | 5/1941 | Weyenberg |
| 2,244,030 | A | | 6/1941 | Teehan |
| 3,191,321 | A | | 6/1965 | Brutting |
| 3,525,165 | A | * | 8/1970 | Randall, Jr. ..... 36/133 |
| 3,626,610 | A | | 12/1971 | Dassler |
| 3,650,051 | A | | 3/1972 | Sass |
| 4,080,745 | A | | 3/1978 | Torrance |
| 4,255,876 | A | | 3/1981 | Johnson |
| 4,308,672 | A | | 1/1982 | Antonious |
| 4,370,818 | A | | 2/1983 | Simoglou |
| 4,373,275 | A | | 2/1983 | Lydiard |
| 4,442,615 | A | | 4/1984 | Danks |
| 4,517,753 | A | | 5/1985 | Rosenbaum et al. |
| 4,616,432 | A | * | 10/1986 | Bunch et al. ..... 36/50.1 |
| 4,617,746 | A | * | 10/1986 | Hannah ..... 36/133 |
| 4,711,043 | A | | 12/1987 | Johnson et al. |
| 5,289,646 | A | | 3/1994 | Kiyosawa |
| 5,337,493 | A | | 8/1994 | Hill |
| 5,437,112 | A | | 8/1995 | Johnston |
| D381,495 | S | | 7/1997 | Avar |
| D391,050 | S | | 2/1998 | Morris |
| 5,826,354 | A | | 10/1998 | Garbujo |
| D431,351 | S | | 10/2000 | Prats et al. |
| 6,449,879 | B1 | | 9/2002 | Fallon et al. |

(Continued)

FOREIGN PATENT DOCUMENTS

| | | |
|---|---|---|
| DE | 2743666 | 3/1978 |

(Continued)

OTHER PUBLICATIONS

International Search Report from PCT Application No. PCT/US2007/086365 mailed Jun. 24, 2008.

*Primary Examiner*—Ted Kavanaugh
(74) *Attorney, Agent, or Firm*—Plumsea Law Group, LLC

(57) ABSTRACT

An article of footwear with a gripping system is disclosed. The gripping system helps to enhance the wearer's ability to contact an athletic ball during kicking. The gripping system can be centered about a region where the wearer tends to kick the ball, and the gripping system can be distributed in a pattern that provides an even or symmetric contact area with the ball.

11 Claims, 14 Drawing Sheets

U.S. PATENT DOCUMENTS

| | | | | |
|---|---|---|---|---|
| D465,320 | S | 11/2002 | Weege | |
| 6,523,282 | B1 * | 2/2003 | Johnston | 36/133 |
| 6,681,503 | B2 | 1/2004 | Morle | |
| D508,308 | S | 8/2005 | Galway | |
| 6,973,746 | B2 | 12/2005 | Auger et al. | |
| 2003/0167658 | A1 | 9/2003 | Davis | |
| 2004/0055183 | A1 | 3/2004 | Lee et al. | |
| 2005/0144812 | A1 * | 7/2005 | Wheeler | 36/133 |
| 2006/0218821 | A1 * | 10/2006 | Hatzilias | 36/133 |

FOREIGN PATENT DOCUMENTS

| | | |
|---|---|---|
| DE | 2801984 | 7/1979 |
| DE | 2827172 | 1/1980 |
| DE | 3314274 | 10/1983 |
| EP | 0496931 | 8/1992 |
| GB | 202859 | 8/1923 |
| GB | 2248171 | 4/1992 |
| GB | 2257893 | 1/1993 |
| GB | 2259639 | 3/1993 |
| RU | 2015675 | 7/1994 |
| WO | WO96/32856 | 10/1996 |

* cited by examiner

ARTICLE OF FOOTWEAR WITH GRIPPING SYSTEM

BACKGROUND OF THE INVENTION

1. Field of the Invention

This invention relates to an article of footwear, and more particularly a sports shoe with a gripping system.

2. Description of Related Art

There are many sports activities that include kicking a ball. Examples of such sports include soccer, football, rugby, Australian-rules football, and kickball. Conventional sports shoes that are available for these sports typically have an upper made of natural or synthetic leather. Other materials such as nylon may also be used. These conventional materials generally do not have high coefficients of friction when contacting the ball, and can fail to properly grip or contact the ball.

Features to increase friction between the ball and shoe have been proposed. Randall (U.S. Pat. No. 3,525,165) teaches a removable flap kicking aid that attaches to the front cleat studs and the shoelaces, acting as a cover to the shoelaces. The removable flap has a series of gripping protrusions that are aligned along the longitudinal axis of the shoe.

Johnston (U.S. Pat. No. 5,437,112) and Lee et al. (U.S. patent application 2004/0055183), both of which are incorporated by reference in their entirety, teach sports shoes having protrusions or strips along the sides of the front portion of the shoe.

There is a need in the art for a sports shoe having a gripping element that is located at an optimal contact location for generating power during kicking and having a gripping element that provides an even or symmetrical contact area.

SUMMARY OF THE INVENTION

An article of footwear including a gripping system is disclosed. In one aspect, the invention provides an article of footwear, comprising: an upper including a gripping system configured to contact a ball; the gripping system including a first gripping member and a second gripping member; the first gripping member being generally circular, and where the second gripping member is disposed around the first gripping member.

In another aspect, the first gripping member and second gripping member are made of a synthetic rubber.

In another aspect, the second gripping member is generally circular in shape and is disposed circumferentially around the first gripping member.

In another aspect, the first gripping member is disposed medial to a longitudinal axis of the article of footwear.

In another aspect, a third gripping member is generally circular in shape and is disposed circumferentially outward of the second gripping member.

In another aspect, the invention provides an article of footwear, comprising: an upper and a sole; the upper including a gripping system configured to contact a ball; wherein the gripping system includes a first gripping member having a disk-like shape.

In another aspect, the gripping system is disposed on an upper surface of the upper.

In another aspect, the gripping system is raised with respect to an upper surface of the upper.

In another aspect, the gripping system comprises a plurality of circumferentially spaced gripping members.

In another aspect, the gripping system includes a second circular gripping member disposed circumferentially outward from the first gripping member, wherein the second gripping member includes a tilted surface.

In another aspect, the gripping system is applied to a substantial majority of a forefoot portion of the article of footwear.

In another aspect, a lacing system of the article of footwear is disposed on a lateral side of the article of footwear.

In another aspect, the invention provides an article of footwear, comprising: an upper and a sole; the upper including a gripping system configured to contact a ball; where the gripping system includes a first gripping member including a first surface and a second gripping member including a second surface; the second gripping member being disposed outward from the first gripping member; the second surface of the second gripping member having a first portion tilted in a first direction, and a second portion that is tilted in a second direction; and where the first direction is different than the second direction.

In another aspect, the first portion is tilted towards a rear end of the upper.

In another aspect, the first portion is disposed clockwise of the second portion, and wherein a transition zone is disposed between the first portion and the second portion.

In another aspect, the invention provides an article of footwear includes a third gripping member being disposed outward from the second gripping member; the third gripping member including a third surface; the third surface of the third gripping member having a third portion tilted in the first direction, and a fourth portion that is tilted in the second direction; where the first direction is different than the second direction.

In another aspect, the first portion and the third portion are tilted in the same first direction, and wherein the second portion and the fourth portion are tilted in the same second direction.

In another aspect, the article of footwear includes a plurality of gripping members, each of the gripping members having a gripping surface, the gripping surface having a transition region with a first portion located clockwise of the transition region and being tilted in the first direction, and a second portion located counter-clockwise of the transition region and being tilted in the second direction.

In another aspect, the first portion is configured to deflect the ball downward.

In another aspect, the second portion is configured to present an edge to the ball thereby enhancing frictional contact with the ball.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
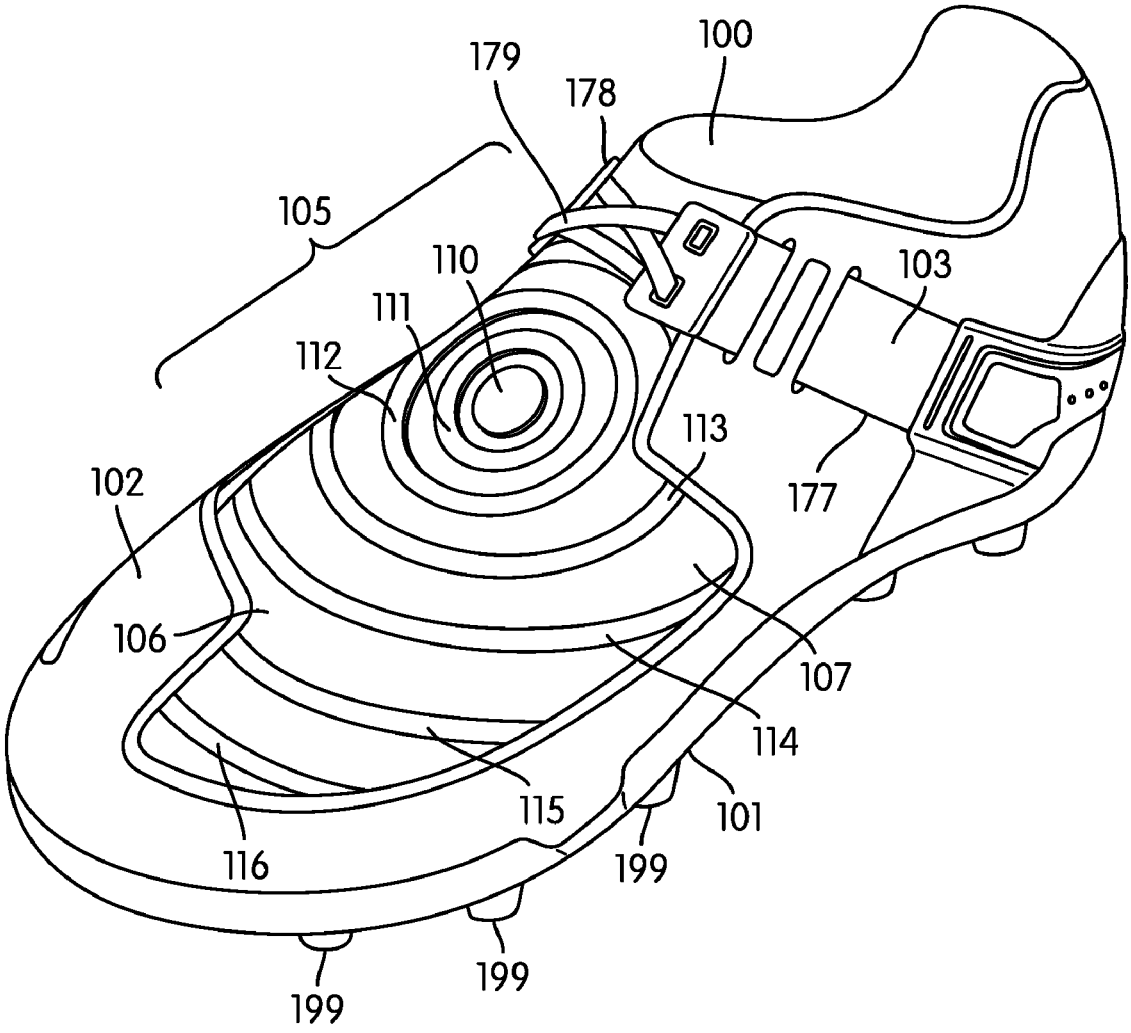
FIG. 1 is an isometric view of a preferred embodiment of an article of footwear having a ball control system.
Figure 2:
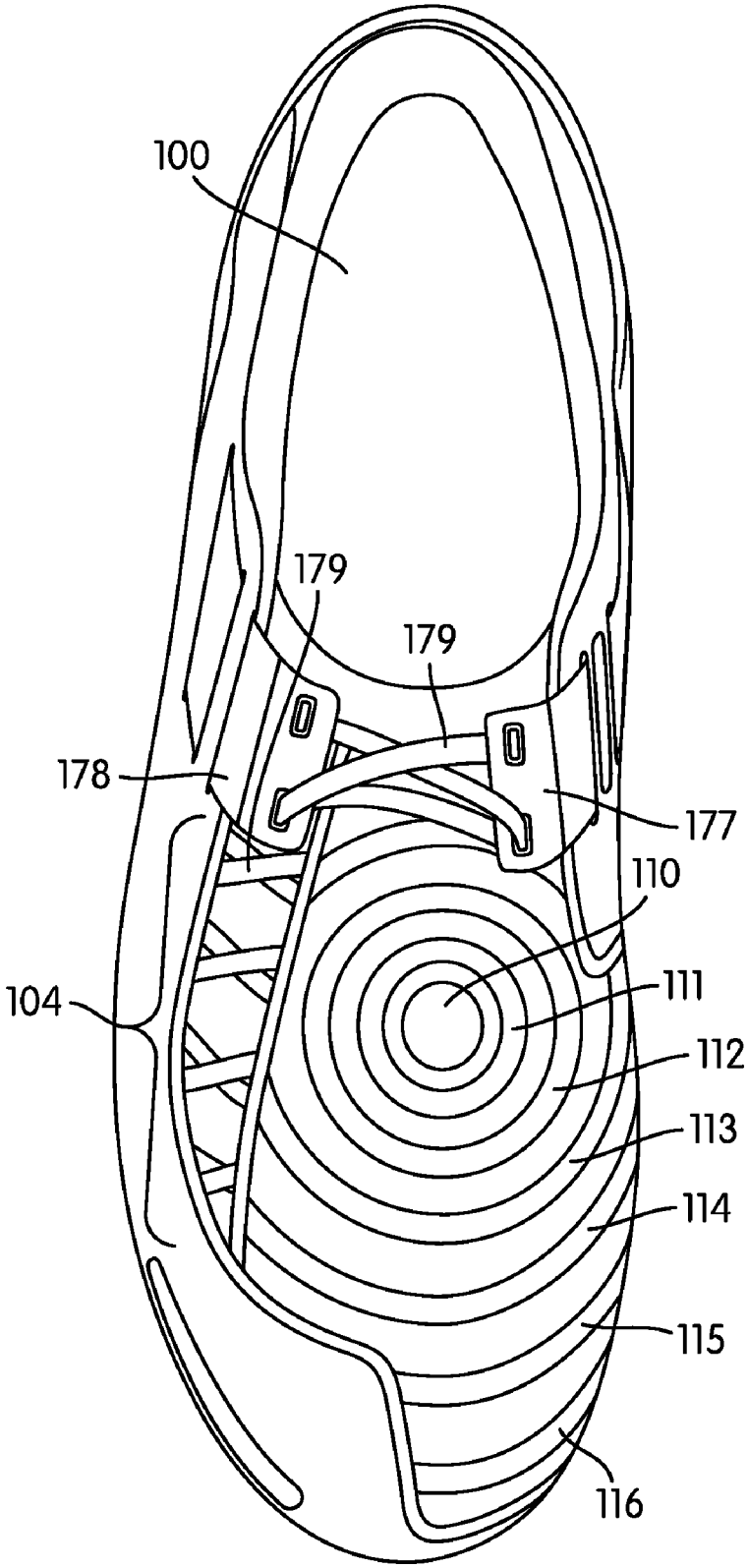
FIG. 2 is a top view of a preferred embodiment of an article of footwear with a ball control system.

FIGS. 1 and 2 illustrate a preferred embodiment of article of footwear 100. For clarity, the following detailed description discusses a preferred embodiment, in the form of a soccer boot, but it should be noted that the present invention could take the form of any article of footwear including, but not limited to, soccer boots, football shoes, rugby shoes, as well as other kinds of shoes.

Article of footwear 100, also referred to as simply article, preferably includes sole 101 and upper 102. Sole 101 may be made from any suitable material, including but not limited to elastomers, siloxanes, natural rubber, other synthetic rubbers, aluminum, steel, natural leather, synthetic leather, or plastics. Preferably, sole 101 includes provisions for providing cleat studs 199 or other traction elements that can enhance traction with the ground. In a preferred embodiment, sole 101 includes cleat studs 199 that are incorporated into sole 101. However, other embodiments may include removable cleats. In a preferred embodiment, sole 101 may use one or more features described in U.S. Pat. No. 6,973,746 to Auger et al, the entirety of which is incorporated by reference. In exemplary embodiment, the cleat assembly described in U.S. Pat. No. 6,973,746 is used in combination with article 100.

In some embodiments, sole 101 may be associated with upper 102. Upper 102 is preferably configured to receive a wearer's foot. Generally, upper 102 may be made from any suitable material, including but not limited to, for example, nylon, natural leather, synthetic leather, natural rubber, or synthetic rubber. Generally, upper 102 can be made of any suitable knitted, woven or non-woven material.

In some embodiments, upper 102 may include shoe fastening system 103. Preferably, shoe fastening system 103 may be used to tighten upper 102 to a wearer's foot. Examples of shoe fastening systems include, but are not limited to, laces, buckles, or Velcro®. In a preferred embodiment, shoe fastening system 103 includes lace 179 as well as first strap 177 and second strap 178 attached to upper 102. Preferably, lace 179 interacts with first strap 177 and second strap 178. Additionally, shoe fastening system 103 may include lateral lacing portion 104. Lateral lacing portion 104 is preferably laterally spaced from the center of article 100. Using this laterally spaced lacing configuration, shoe fastening system 103 is designed to avoid interference with gripping system 105.

In some cases, article of footwear 100 may be used in athletic activities associated with a ball, such as a soccer ball. In order to achieve better contact with the ball, and in some cases, apply some curvature in the trajectory of the kick, it may be necessary for the kicker to apply some spin to the ball. Preferably, upper 102 may include provisions for enhancing the ability to contact and control the ball when kicked.

In some embodiments, upper 102 may include gripping system 105 disposed along upper surface 106 of upper 102. Preferably, gripping system 105 may include a plurality of gripping members. In a preferred embodiment shown in the Figures, upper 102 includes first gripping member 110, second gripping member 111, third gripping member 112, fourth gripping member 113, fifth gripping member 114, sixth gripping member 115 and seventh gripping member 116. Preferably, gripping members 111-116 are disposed in concentric rings along upper surface 106, as seen in the Figures. Gripping member 110 may be disposed in the center of these concentric rings. In other embodiments, the number of gripping members comprising gripping system 105 may vary.

In this preferred embodiment, gripping members 110-116 are generally circular and have a ring-like or disk-like shape, however in other embodiments, gripping members 110-116 may be formed as a different shape, including but not limited to square, rectangular, diamond, oval, star, as well as other shapes. In some embodiments, gripping members 110-116 may be constructed in the shape of a manufacturer's logo, an athletic team's logo, or other kinds of patterns.

In the preferred embodiment, gripping members 110-116 may be disposed on upper surface 106 and raised with respect to upper surface 106. In this configuration, gripping members 110-116 are designed to make initial contact with a ball before upper surface 106.

In some embodiments, gripping members 110-116 may be made of a high friction material. Preferably, gripping members 110-116 are made of a material with a higher coefficient of friction than upper 102. In some embodiments, materials may be used that enhance gripping when in the presence of moisture. Examples of such materials include, but are not limited to, roughened leathers, rubbers, silastics, or any synthetic or natural elastomeric material such as styrene-butadiene, or polyurethane. In a preferred embodiment, gripping members 110-116 are made of rubber.

Figure 3:
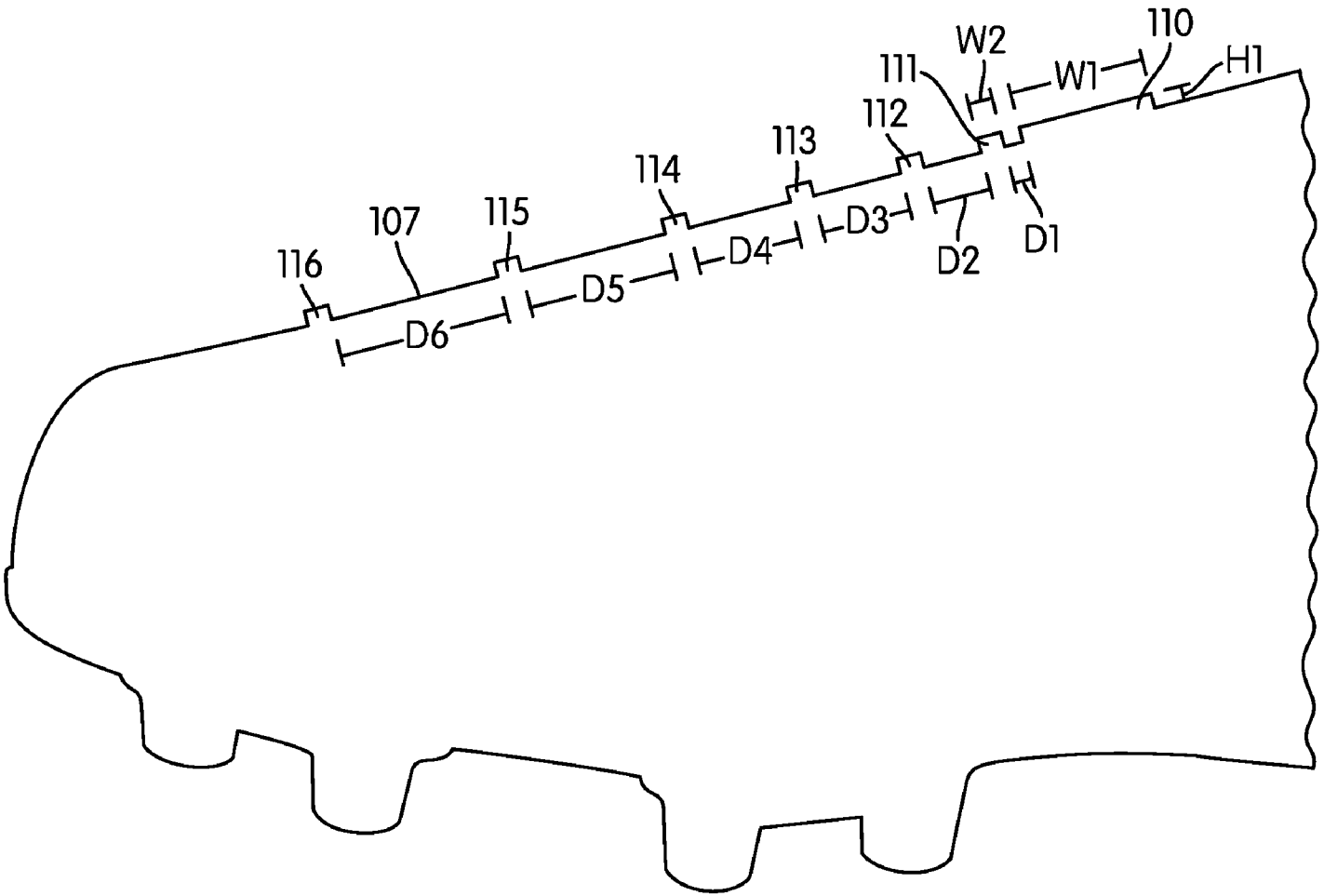
FIG. 3 is a side view of a preferred embodiment of a gripping system.

Generally, gripping members 110-116 may be any desired size and may be spaced apart by intervals of varying distances. Preferably, gripping members are sized and located so that the contact area between gripping members 110-116 and a ball may be optimized. Referring to FIG. 3, the spacing and dimensions of gripping members 110-116 are illustrated schematically. Generally, first gripping member 110 has a circular disk-like shape. In this embodiment, gripping member 110 has a first width W1. Preferably, the remaining gripping members 111-116 have a ring-like geometry. In some embodiments, second gripping member 111 may have a second width W2. In a preferred embodiment, gripping members 112-116 may also have a width similar to second gripping member 111 and may have a similar second width, W2. In other embodiments, the widths of each gripping members 110-116 may vary.

By adjusting widths W1 and W2, the contact area between a ball and gripping system 105 may be varied. Generally, a larger contact area may increase grip and friction between a ball and gripping system 105, while a smaller contact area may decrease friction between a ball and gripping system 105.

Additionally, the spacing between each of the gripping members 110-116 may vary. In this embodiment, gripping members 110 and 111 are separated by a first distance D1; gripping members 111 and 112 are separated by a second distance D2; gripping members 112 and 113 are separated by a third distance D3; gripping members 113 and 114 are separated by a fourth distance D4; gripping members 114 and 115 are separated by a fifth distance D5; and gripping members 115 and 116 are separated by a sixth distance D6.

These distances may be ordered from least to greatest as: D1, D2, D3, D4, D5, D6. In other words, the spacing between two adjacent gripping members preferably increases the further the gripping members are from first gripping member 110. This arrangement helps to provide a balance between friction and control. Other distance arrangements can be used to vary the response characteristics of gripping system 105.

Using this preferred spacing, increased friction may be applied to a ball by gripping system 105 in regions where gripping members 110-116 are closest. In this embodiment, gripping members 110-116 are closest in the region proximate first gripping member 110. Varying the distances between gripping members 110-116 may vary the location of the regions of increased traction.

Preferably, gripping members 110-116 are elevated above top surface 107. Specifically, gripping members are elevated to a height that may optimize contact area between gripping members and ball. In this embodiment, first gripping member 110 has first height H1. Preferably, heights of gripping members 111-116 are substantially similar to first height H1. In other embodiments, the heights of gripping members 111-116 may vary. With this preferred raised arrangement, gripping members 110-116 may be raised high enough above top surface 107 to minimize contact between top surface 107 and a ball, but not so high that gripping members 110-116 deform substantially upon contact with a ball. In some embodiments, top surface 107 may be made of Gore-Tex® or can include a Gore-Tex® layer. The use of Gore-Tex® in combination with other features is optional and is not used in every embodiment.

Figure 4:
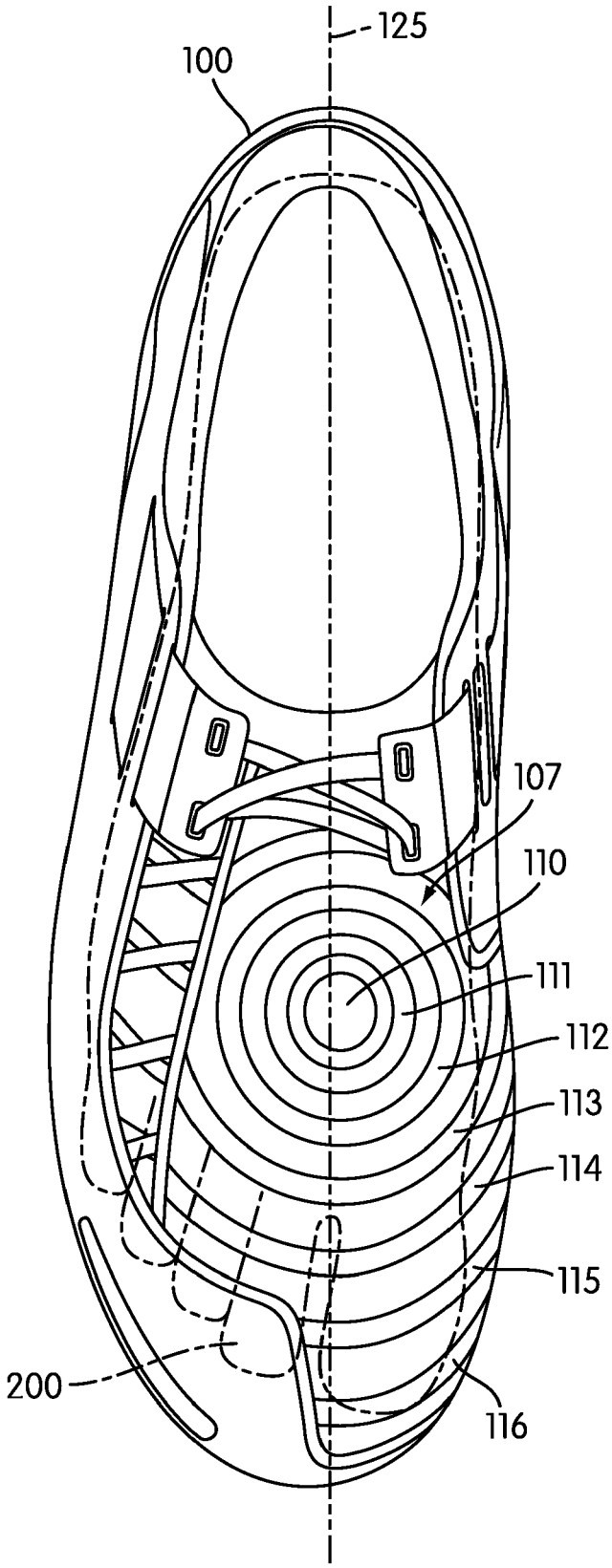
FIG. 4 is a top view of a preferred embodiment of an article of footwear with a ball control system with a phantom foot located within article of footwear.

In some cases, the placement of gripping members 110-116 on upper 102 may further enhance a wearer's ability to contact a ball and control the spin of the ball. Preferably, the centers of gripping members 110-116 are disposed in a location or locations that are optimal for contacting a ball. FIG. 4 is a preferred embodiment of article of footwear 100 with foot 200 shown in phantom disposed over article of footwear 100. Preferably, gripping members 110-116 are disposed over the region of foot 200 where the force transfer between foot 200 and a ball is optimal, and where most wearers tend to kick a ball. In a preferred embodiment, gripping members 110-116 may be centered on top surface 107 of article of footwear 100 slightly medial to longitudinal 125 axis of article of footwear 100. Using this configuration, article of footwear 100 preferably provides enhanced gripping of a ball during kicking, allow the user to easily apply spin in any direction.

Figure 5:
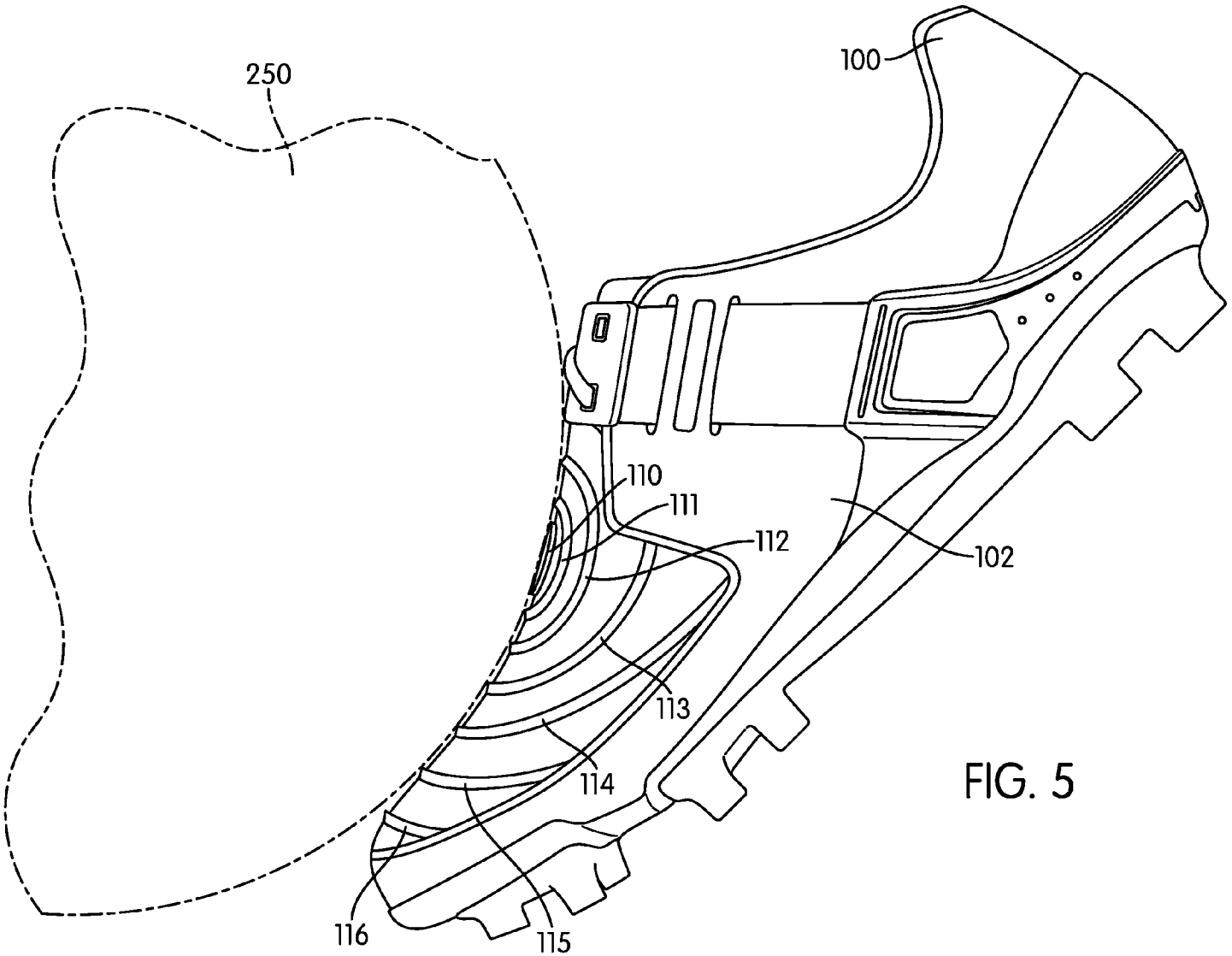
FIG. 5 is a side view of a preferred embodiment of an article of footwear with a ball control system contacting a ball.

FIG. 5 illustrates the orientation of gripping members 110-116 at a preferred location for transferring force from the foot to the ball during kicking. In FIG. 5, which is a schematic side view, article 100 is contacting ball 250. Preferably, gripping members 110-116 are disposed on upper 102 in a manner that maximizes the contact area between gripping members 110-116 and ball 250. This large contact area preferably facilitates friction between ball 250 and article 100.

Figure 6:
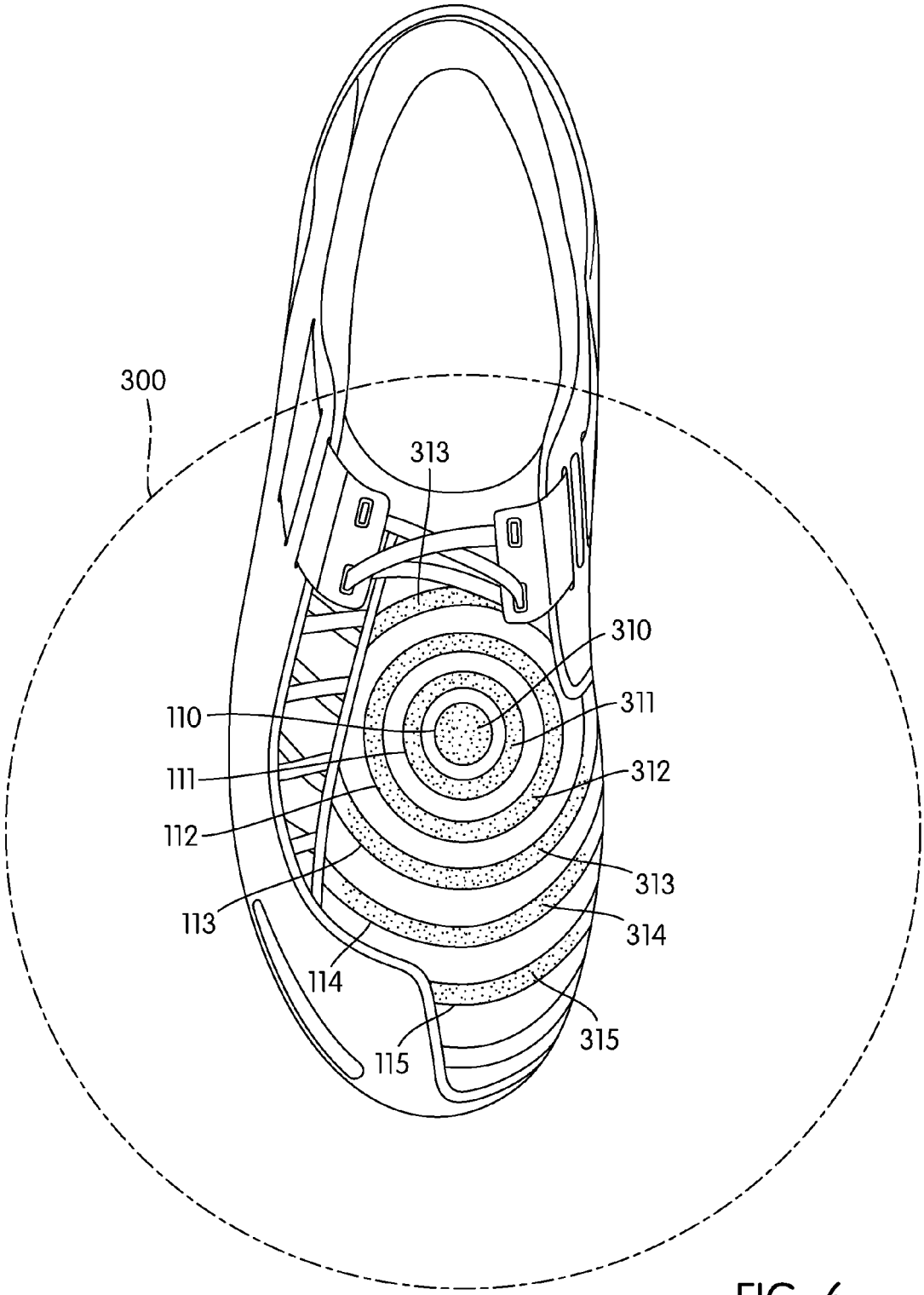
FIG. 6 is a top view of a preferred embodiment of an article of footwear with a ball control system and a ball.
Figure 7:
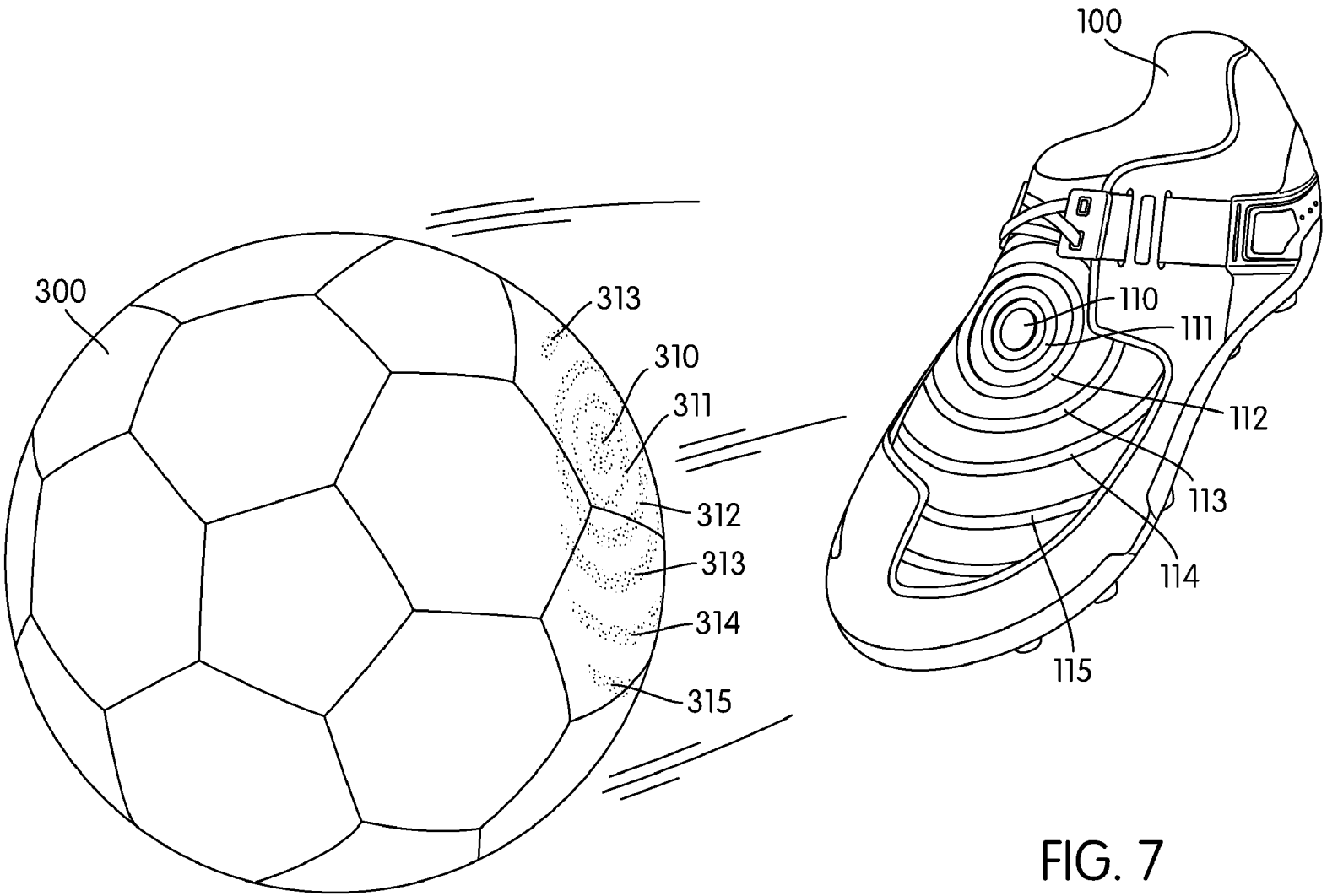
FIG. 7 is an isometric view of a preferred embodiment of an article of footwear with a ball control system and a ball.

Preferably, the contact area between the ball and the article of footwear occurs evenly and possibly symmetrically. Even distribution of the contact area provides the wearer of article 100 with the ability to firmly and positively contact ball 250. FIGS. 6 and 7 illustrate the even distribution of contact areas. In contrast to the preferred even and symmetric distribution of gripping system 105, related art protrusion or strips mounted to an article of footwear may cause unpredictable deflection of a ball during kicking. However, the preferred even and symmetric gripping system 105 provides a firm and predictable contact area with ball 250.

FIGS. 5, 6 and 7 demonstrate the even and symmetric nature of gripping system 105. FIGS. 5 and 6 show embodiments at an instance of contact with ball 250, and FIG. 7 is an embodiment showing article 100 and ball 300 after contact. In FIG. 7, ball 300 has been rotated, so that the contact pattern or area is visible. As shown in FIG. 7, ball 300 includes a number of shaded regions that represent one example of the portions of ball 300 that were contacted by gripping system 105. It can be observed that the contact area generally corresponds to gripping system 105.

As shown in FIG. 7, ball 300 includes first shaded region 310 that illustrates the contact area between ball 300 and first gripping member 110. Also, ball 300 includes second shaded region 311 that illustrates the contact area between ball 300 and second gripping member 111, third shaded region 312 illustrates the contact area between ball 300 and third gripping member 112, fourth shaded region 313 illustrates the contact area between ball 300 and fourth gripping member 113, fifth shaded region 314 illustrates the contact area between ball 300 and fifth gripping member 114, and sixth shaded region 315 illustrates the contact area between ball 300 and sixth gripping member 115. It can be observed in FIG. 7, that gripping system 105 provides an even and symmetric contact pattern on ball 300. In this example, seventh gripping member 116 does not contact ball 300. However, it should be noted that seventh gripping member 116 may contact ball 300 in other examples.

Spin may be applied to ball 300 by gripping members 110-115 when the spin is applied in a direction perpendicular to the orientation of gripping members 110-115. For circular designs, all directions moving away from or towards the center of the circle are perpendicular to the circle. In a preferred embodiment, the generally circular design of gripping system 105 allows spin to be applied in any direction perpendicular to gripping members. Using this configuration, spin can be easily placed on ball 300 in any direction during kicking when article 100 is equipped with gripping system 105. This preferred configuration of article of footwear 100 gives a kicker tremendous flexibility to place any direction of spin on ball 300 that the situation requires.

In many cases, a gripping system may include provisions that provide the wearer with the ability to apply different types of spin. In the previous embodiments, the surfaces of the gripping members were generally flattened or parallel to the top surface of the outsole. In other embodiments, an article of footwear may include gripping members with multiple surface orientations. Generally, elevated gripping members may be provided with surface orientations that maximize the contact area between the gripping members and the ball. Preferably, these gripping member surfaces are oriented to provide enhanced control of spin during kicking. In particular, multiple surface orientations are provided for enhanced control of spin with each surface orientation associated with a certain type of kick or spin.

Figure 8:
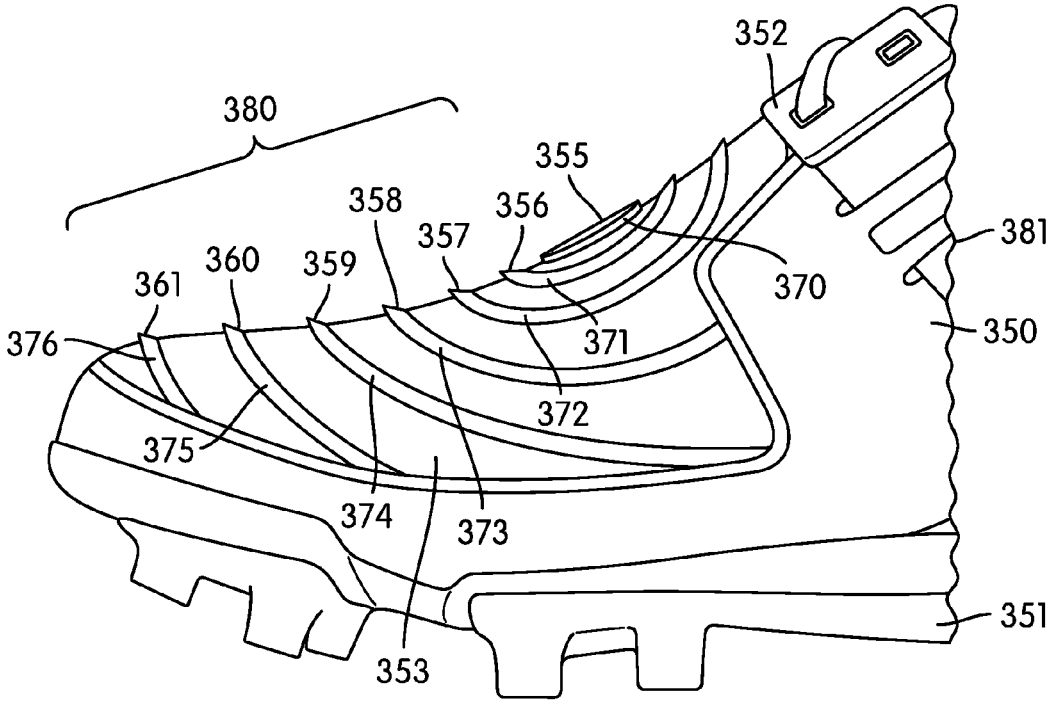

Referring to FIG. 8, article of footwear 350 includes sole 351 and upper 352. In this embodiment, upper 352 preferably includes the following gripping members: first gripping member 355, second gripping member 356, third gripping member 357, fourth gripping member 358, fifth gripping member 359, sixth gripping member 360, and seventh gripping member 361 disposed on upper surface 353. Gripping members 355-361 may preferably be elevated with respect to upper surface 353.

Additionally, gripping members 355-361 may have surfaces that are oriented in a preconfigured direction. In particular, each of the gripping members 355-361 may include a respective outer surface. In the embodiment shown in FIG. 8, first gripping member 355 includes first surface 370, second gripping member 356 includes second surface 371, third gripping member 357 includes third surface 372, fourth gripping member 358 includes fourth surface 373, fifth gripping member 359 includes fifth surface 374, sixth gripping member 360 includes sixth surface 375, and second gripping member 361 includes seventh surface 376. In this embodiment, surfaces 371-376 are preferably tilted towards first central gripping member 355. It can be observed in FIG. 8, that the forefoot or toe portions of surfaces 371-376 are oriented facing proximal or towards the kicker. It can also be observed that all of the surfaces are tilted in the same direction.

Figure 9:
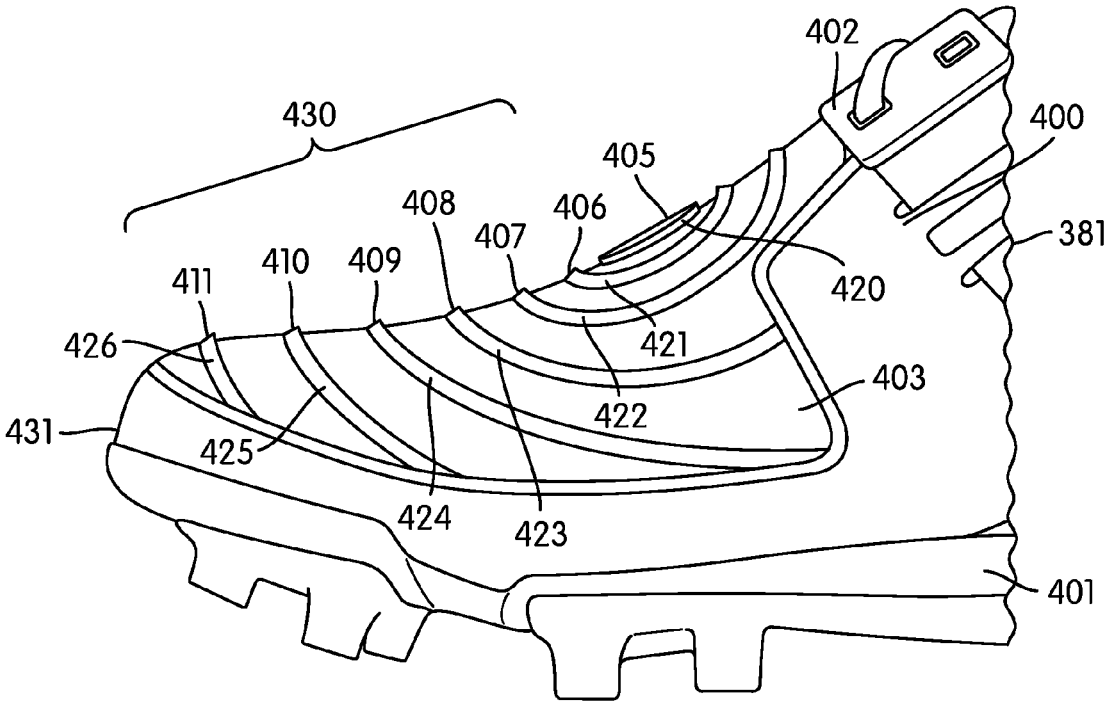
FIG. 9 is a side view of an article of footwear with a ball control system.
Figure 10:
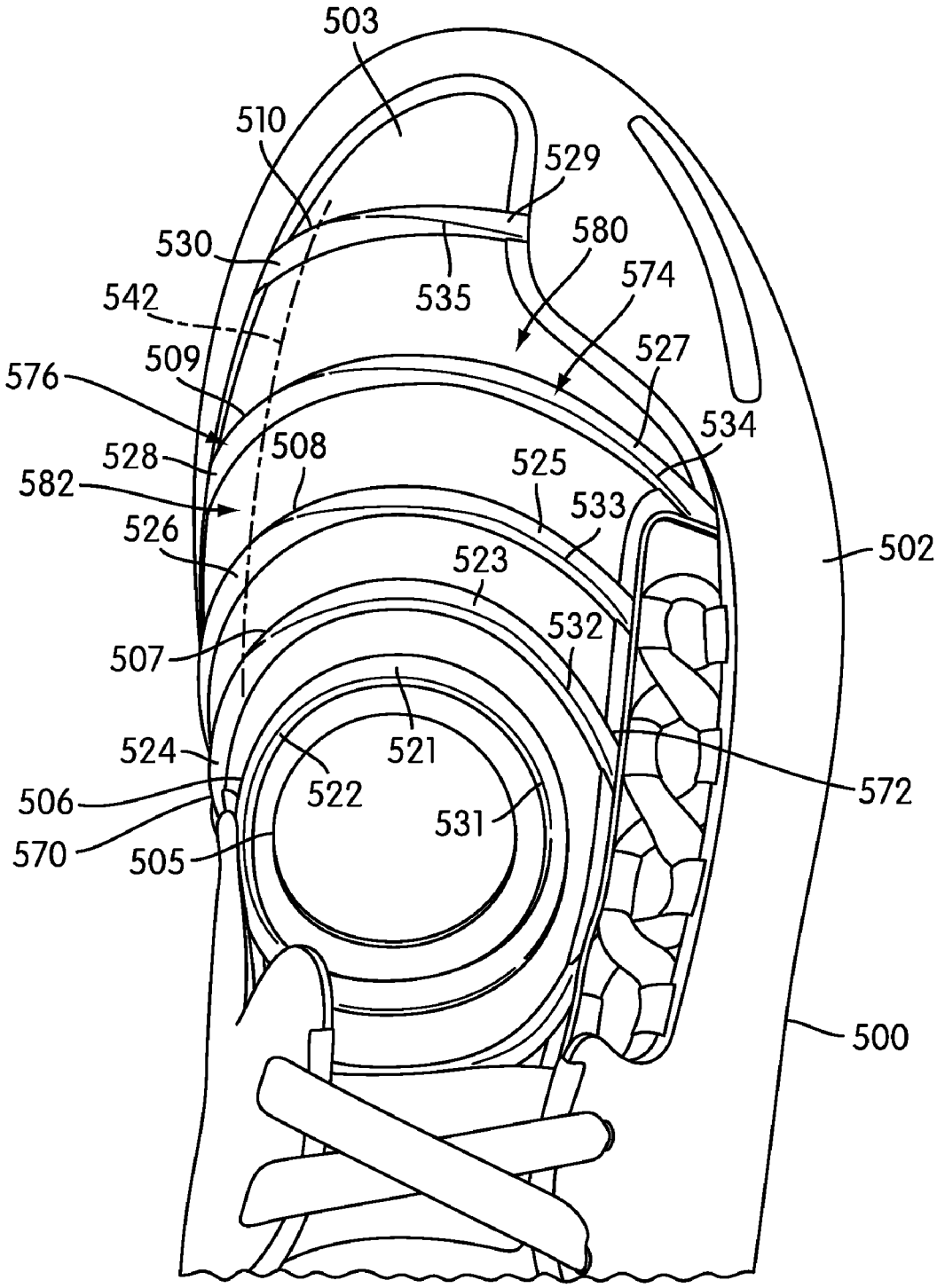
FIG. 10 is a top view of a preferred embodiment of an article of footwear with a ball control system.
Figure 11:
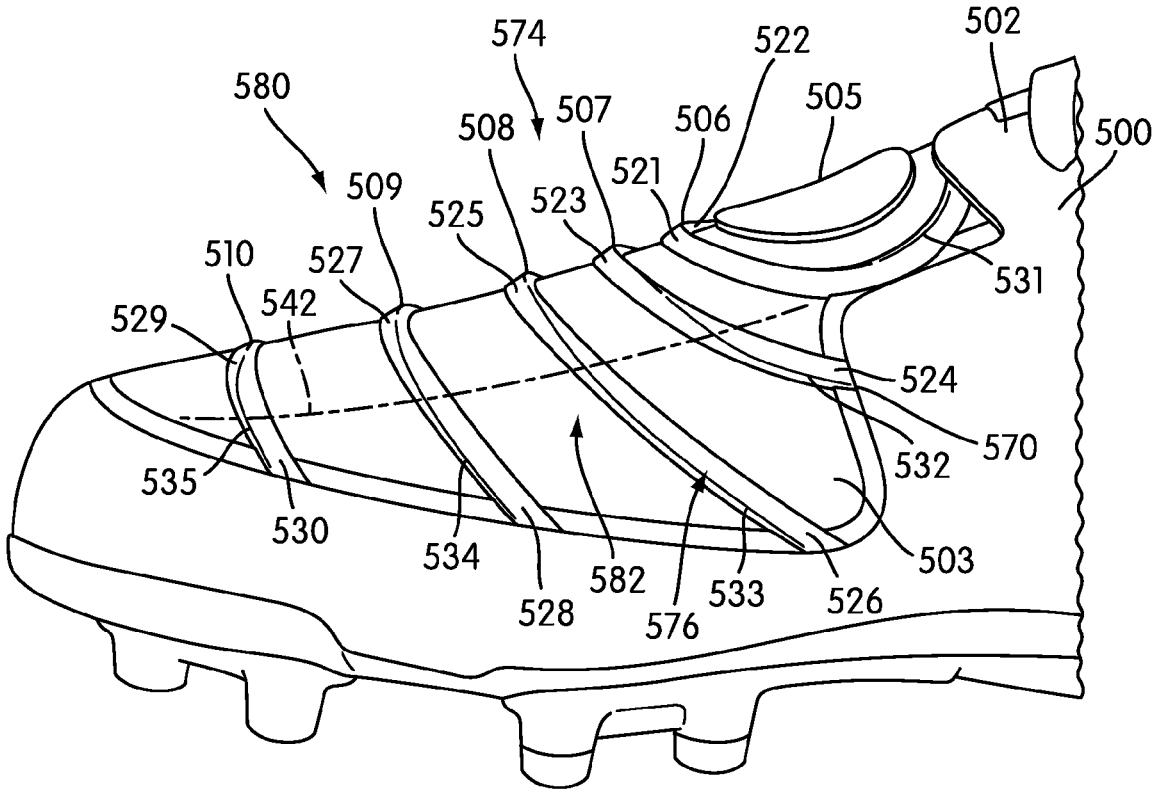
FIG. 11 is a side view of a preferred embodiment of an article of footwear with a ball control system.

In another embodiment, the surfaces of the gripping members may be tilted away from the central gripping member. Referring to FIG. 9, article of footwear 400 includes sole 401 and upper 402. Upper 402 preferably includes a plurality of gripping members including: first gripping member 405, second gripping member 406, third gripping member 407, fourth gripping member 408, fifth gripping member 409, sixth gripping member 410, and seventh gripping member 411 disposed on upper surface 403. Gripping members 405-411 may preferably be elevated with respect to upper surface 403.

Additionally, gripping members 405-411 may have surfaces that are oriented in a preconfigured direction. In particular, gripping members 405-411 may include corresponding first surface 420, second surface 421, third surface 422, fourth surface 423, fifth surface 424, sixth surface 425 and seventh surface 426. In this embodiment, surfaces 421-426 are preferably tilted away from first gripping member 405. It can be observed in FIG. 9, that the forefoot or toe portions of surfaces 421-426 are oriented facing distal or away from the kicker. Similar to the embodiment shown in FIG. 8, it can also be observed in FIG. 9 that all of the surfaces are tilted in the same direction.

Each of the distinct gripping member surface orientations shown in FIGS. 8 and 9 are preferably configured to give the kicker optimal control of particular types of kicks. For example, the embodiment shown in FIG. 8 including gripping member surfaces that are oriented towards the central gripping member may be optimally configured for imparting spin on the ball. In contrast, the embodiment shown in FIG. 9 including gripping member surfaces that are oriented away from the central gripping member may be configured to deflect the ball downwards, keep hard shots low, and prevent errant high balls.

In many cases, a gripping system may include provisions that provide the wearer with the ability to apply different types of spin depending on the region of the shoe contacting the ball. The ability to apply different types of spin may occur during a sport such as soccer, where a wearer of article of footwear may require topspin on a ball kicked hard and may alternately require sidespin on a ball that is passed. In a preferred embodiment, an article of footwear includes a gripping system with multiple surface orientations of the gripping members.

In the previous embodiments, the surfaces of the gripping members were tilted in directions either towards the central disk-shaped gripping member, or away from the central disk-gripping member. In some embodiments, it may be desirable to have gripping members with surfaces that are oriented in one direction at one portion of the upper, and that are oriented in a different direction at another portion of the upper. This feature may facilitate a player's ability to apply different types of spins or impart different types of trajectories to a ball.

Referring to FIGS. 10-13, in some embodiments, an article of footwear preferably includes gripping members with two distinct surface orientations configured to facilitate different types of kicks. In this embodiment, upper 502 of article of footwear 500 includes first gripping member 505, second gripping member 506, third gripping member 507, fourth gripping member 508, fifth gripping member 509, and sixth gripping member 510, disposed on upper surface 503. As shown in the Figures, the general arrangement of gripping members 505-510 is similar to previous embodiments, with gripping members 506-510 arranged in concentric rings around first gripping member 505.

Preferably, each of the gripping members 506-510 is associated with an outer surface that twists along the gripping members. Third gripping member 507 provides the clearest example of this preferred twisting arrangement. In some embodiments, third gripping member 507 includes outward tilted surface 523 and inward tilted surface 524. The orientation of outward tilted surface 523 is preferably away from first gripping member 505 at all points along third gripping member 507. Likewise, the orientation of inward tilted surface 524 is preferably towards first gripping member 505 at all points along third gripping 507. In other words, outward tilted surface 523 is preferably oriented similar to the gripping surfaces 421-426 shown in FIG. 9, while inward tilting surface 524 is preferably oriented similar to gripping surfaces 371-376 shown in FIG. 8.

In this embodiment, transition zone 532 defines a boundary between outward tilted surface 523 and inward titled surface 524. In the direction moving clockwise from first end 570 of third gripping member 507, transition zone 532 can be considered the region of twist along gripping member 507. As viewed from above in FIG. 10, this twisting results in a shrinking of inward tilted surface 524 and an enlarging of outward titled surface 523, in the clockwise direction between first end 570 and second end 572. In a preferred embodiment, transition zone 532 may not be a clearly defined line as seen in the Figures, but rather a general region of subtle transition.

In some embodiments, the remaining gripping members 506 and 508-510 may all include similar outwardly and inwardly tilting surfaces. In particular, second gripping member 506 preferably includes second outward tilting surface 521 and second inward tilting surface 522 associated with second transition zone 531; fourth gripping member 508 includes third outward tilting surface 525 and third inward tilting surface 526 associated with third transition zone 533, fifth gripping member 509 includes fourth outward tilting surface 527 and fourth inward tilting surface 528 associated with fourth transition zone 534; and sixth gripping member 510 includes fifth outward tilting surface 529 and fifth inward tilting surface 530 associated with fifth transition zone 535. For purposes of clarity it is useful to group all the outward tilting surfaces 521, 523, 525, 527 and 529 as first gripping region 574. Likewise it is useful to group all the inward tilting surfaces 522, 524, 526, 528 and 530 as second gripping region 576.

Preferably, first gripping region 574 and second gripping region 576 may be disposed on different portions of upper 502. Generally, first gripping region 574 may be disposed on instep portion 580 of upper 502, while second gripping region 576 may be disposed on side portion 582 of upper 502. In this embodiment, curve 542 is associated with the boundary between first gripping region 574 and second gripping region 576.

Figure 12:
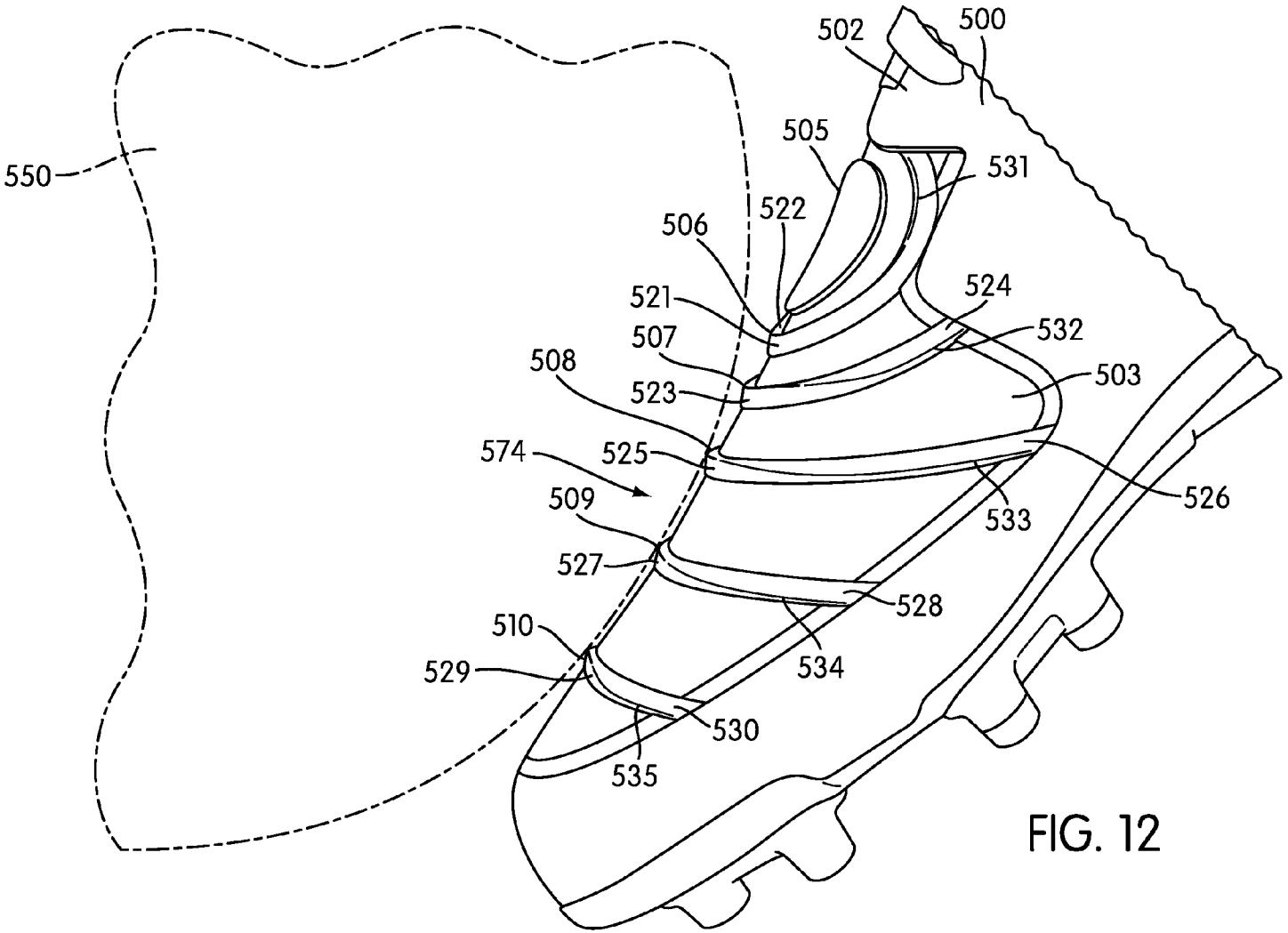
FIG. 12 is a side view of a preferred embodiment of an article of footwear with a ball control system and a ball.

As previously discussed, the outward tilting surfaces of gripping members may generally tend to deflect a ball downwards. Therefore, if a player wishes to keep the trajectory of a ball low, they may kick a ball with instep portion 580 where first gripping region 574 is disposed. As seen in FIG. 12, as ball 550 contacts gripping members 508-510, ball 550 is disposed against first gripping region 574. As the ball is kicked, first gripping region 574 is designed to impart a downward spin or trajectory.

Figure 13:
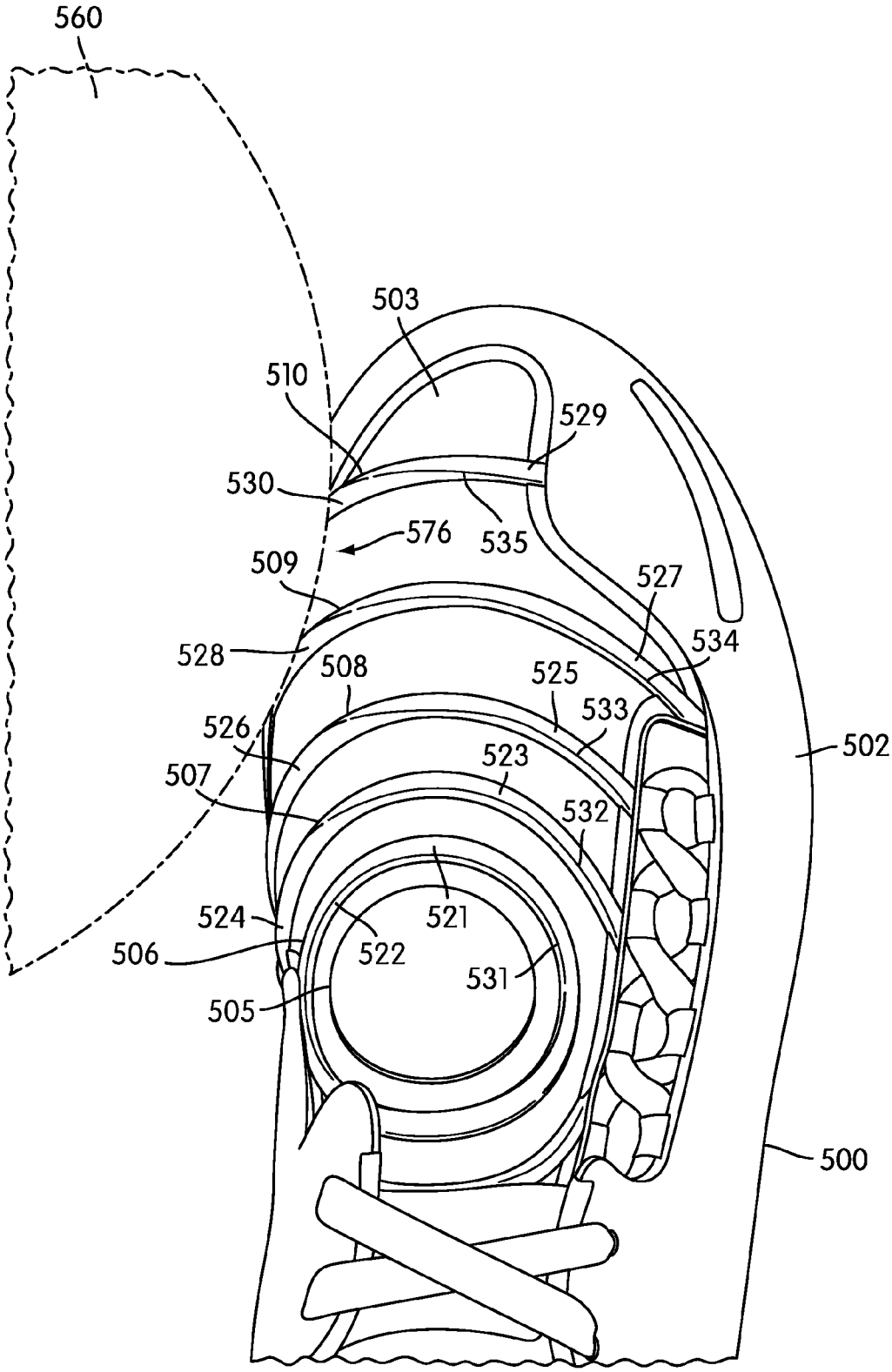
FIG. 13 is a top view of a preferred embodiment of an article of footwear with a ball control system and a ball.

Furthermore, as previously discussed, the inward tilting surfaces of gripping members may generally tend impart additional spin to a ball. Therefore, if a wearer wishes to curl the ball for a pass or a curved shot, the wearer may kick a ball with side portion 582 where second gripping region 576 is disposed. As seen in FIG. 13, as ball 560 contacts gripping members 509 and 510, ball 560 is disposed against second gripping region 576. As the ball is kicked, the leading edges of second gripping region 576, which are generally sharp, help to impart additional spin, causing a curved trajectory.

In the current embodiment, curve 542 has the shape of an arc that is generally shaped like a medial edge of upper 502 at the forefoot. With this configuration, first gripping region 574 is disposed further towards side portion 582 at fourth gripping member 508 and fifth gripping member 509. This preferred arrangement may be used by a player who wants to have equal ability to direct a ball downwards using first gripping region 574 and apply curl to a ball using second gripping region 576.

Figure 14:
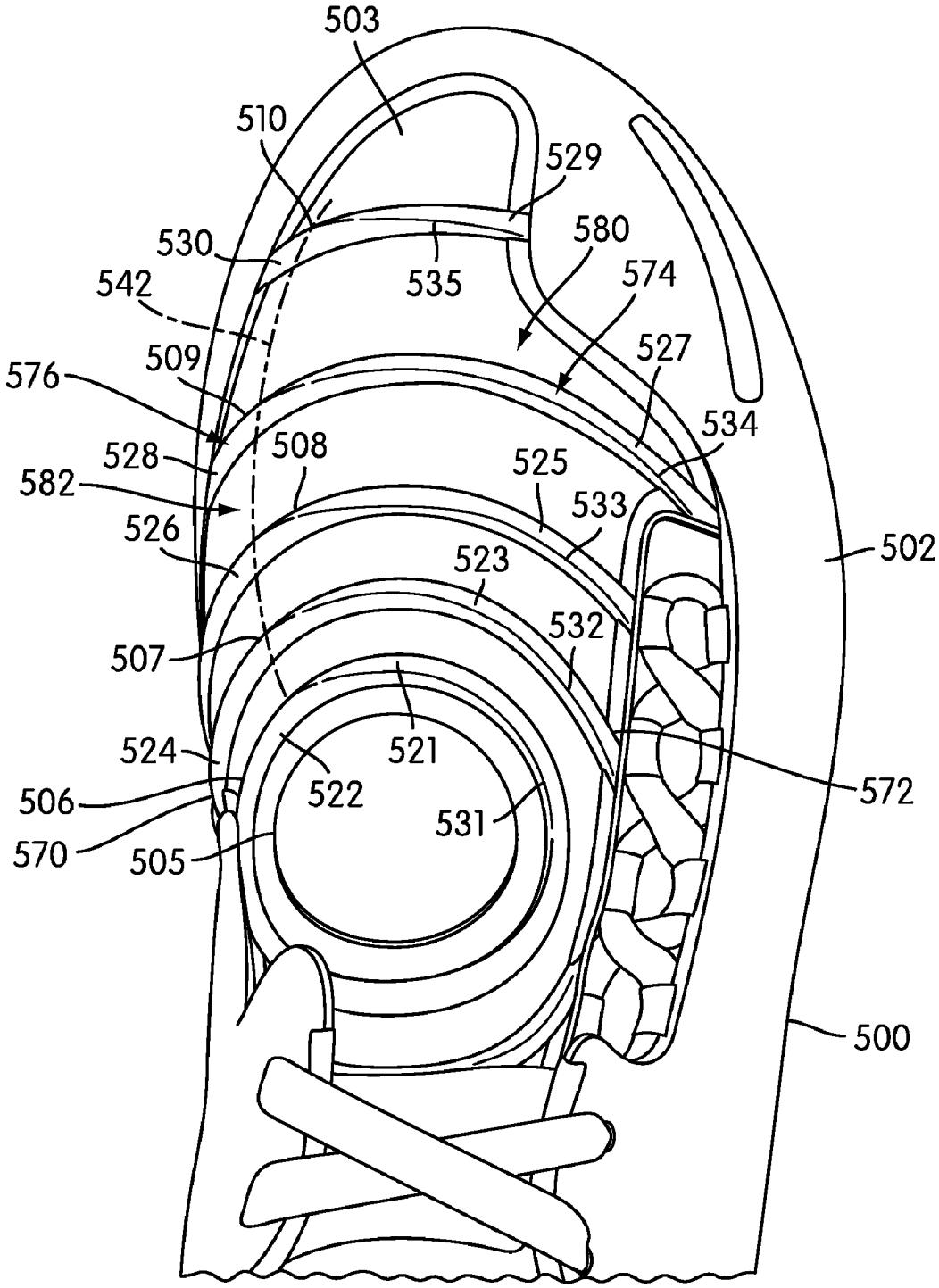
FIG. 14 is a top view of a preferred embodiment of an article of footwear with a ball control system.

In other embodiments, however, the boundary between first gripping region 574 and second gripping region 576, defined by curve 542 may be modified. For example, a player such as a striker or forward in soccer may be mostly kicking low passes or low trajectory shots. Therefore, it may be preferable to have a configuration where first gripping region 574 dominates upper 502 over second gripping region 576. FIG. 14 represents an alternative embodiment of article of footwear 500 where curve 542 has an arc that bulges significantly at fourth gripping member 508 and fifth gripping member 509. Using this configuration, a player may can make use of a larger contact area of upper 502 from which to impart a downward direction using first gripping member 574, while kicking.

Figure 15:
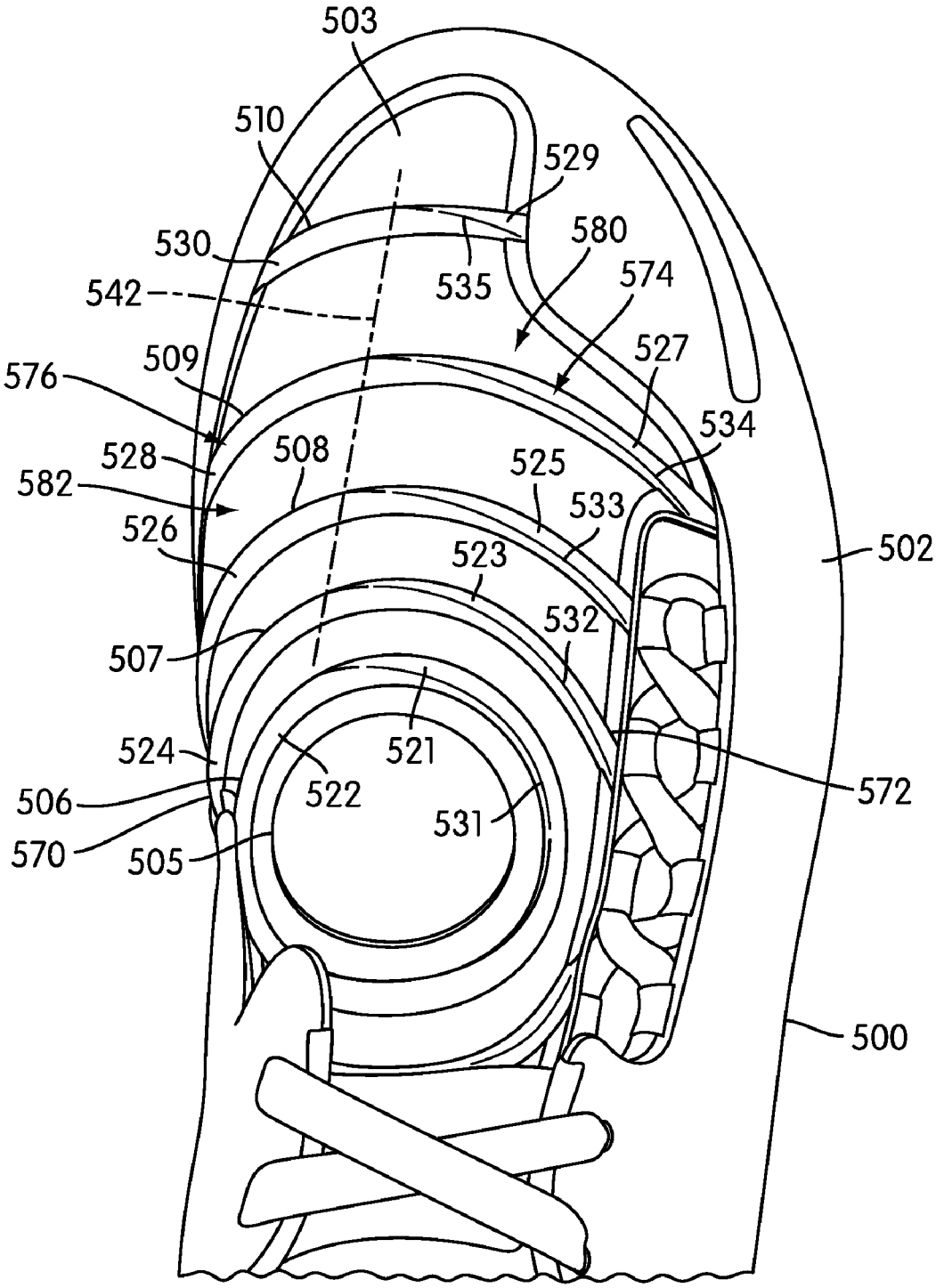
FIG. 15 is a top view of a preferred embodiment of an article of footwear with a ball control system.

In still another embodiment, shown in FIG. 15, curve 542 may not be an arc, but rather a straight line. In this embodiment, the area of second gripping region 576 is increased over the previous embodiments. This configuration may be useful for a mid-fielder or other players that tend to pass more, as more of upper 502 is covered by second gripping region 576.

In some embodiments, gripping members may include provisions that help to increase friction or grip between the gripping member and a ball. These provisions may include features disposed on the upper surfaces of the gripping members. In some cases, the upper surfaces of the gripping members may be roughened, cut or include channels or grooves. It is also possible to provide protrusions or small projections on the upper surfaces of the gripping members. These various features can, in some cases, help to improve friction or grip between the gripping member and a ball. Some of these features are particularly helpful in adverse playing conditions. For example, a roughened outer surface, or an outer surface with grooves may help to improve friction during wet or rainy conditions. The upper surface features for the gripping members can be selected according to player preference or to match a certain playing condition.

It is also possible to independently arrange the upper surface feature of each gripping member. In other words, different gripping members on the same article may have different upper surface features. For example, it is possible that one gripping member include a roughened upper surface, while another gripping member on the same article include an upper surface with protrusions. It is also possible to provide the same upper surface feature to every gripping member on an article. The gripping member upper surface feature can be applied to any of the embodiments disclosed above.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

I claim:

1. An article of footwear, comprising:

an upper and a sole;

the upper including a gripping system configured to contact a ball;

wherein the gripping system includes a first gripping member including a first surface and a second gripping member including a second surface;

the second gripping member being ring shaped and disposed circumferentially outward from the first gripping member;

the second surface of the second gripping member having a first portion tilted in a first direction, and a second portion that is tilted in a second direction; and wherein the first direction is different than the second direction.

2. The article of footwear according to claim 1, wherein the first portion is tilted towards a rear end of the upper.

3. The article of footwear according to claim 2, wherein the first portion is disposed clockwise of the second portion, and wherein a transition zone is disposed between the first portion and the second portion.

4. The article of footwear according to claim 1, wherein the article of footwear includes a third gripping member being disposed outward from the second gripping member;

the third gripping member including a third surface; the third surface of the third gripping member having a third portion tilted in the first direction, and a fourth portion that is tilted in the second direction;

wherein the first direction is different than the second direction.

5. The article of footwear according to claim 4, wherein the first portion and the third portion are tilted in the same first direction, and wherein the second portion and the fourth portion are tilted in the same second direction.

6. The article of footwear according to claim 1, wherein the article of footwear includes a plurality of gripping members, each of the gripping members having a gripping surface, the gripping surface having a transition region with a first portion located clockwise of the transition region and being tilted in the first direction, and a second portion located counter-clockwise of the transition region and being tilted in the second direction.

7. The article of footwear according to claim 6, wherein the first portion is configured to deflect the ball downward.

8. The article of footwear according to claim 6, wherein the second portion is configured to present an edge to the ball thereby enhancing frictional contact with the ball.

9. The article of footwear according to claim 1, wherein the first gripping member is circular.

10. The article of footwear according to claim 1, wherein the first gripping member has a disk-like shape.

11. The article of footwear according to claim 1, wherein the first gripping member is generally circular.

* * * * *